US009199496B2

(12) United States Patent
Hobo et al.

(10) Patent No.: US 9,199,496 B2
(45) Date of Patent: Dec. 1, 2015

(54) BELT CLEANER AND IMAGE FORMING APPARATUS

(71) Applicant: KYOCERA Document Solutions Inc., Osaka (JP)

(72) Inventors: Jumpei Hobo, Osaka (JP); Hidenori Takenaka, Osaka (JP); Masami Ikeda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/220,441

(22) Filed: Mar. 20, 2014

(65) Prior Publication Data

US 2014/0292967 A1 Oct. 2, 2014

(30) Foreign Application Priority Data

Mar. 26, 2013 (JP) ..... 2013-064089
Mar. 26, 2013 (JP) ..... 2013-064090
Mar. 26, 2013 (JP) ..... 2013-064091

(51) Int. Cl.
*B41J 29/38* (2006.01)
*B41J 29/17* (2006.01)
*B41J 11/00* (2006.01)

(52) U.S. Cl.
CPC ..... *B41J 29/17* (2013.01); *B41J 11/007* (2013.01)

(58) Field of Classification Search
CPC ..... B41J 11/007; B41J 15/048
USPC ..... 347/16, 101, 6
See application file for complete search history.

(56) References Cited

U.S. PATENT DOCUMENTS

| | | | | |
|---|---|---|---|---|
| 4,860,883 | A * | 8/1989 | Knaul et al. | 198/495 |
| 5,526,028 | A * | 6/1996 | Rottman | 347/23 |
| 6,679,601 | B1 * | 1/2004 | Pham et al. | 347/104 |
| 7,036,905 | B2 * | 5/2006 | Nagai et al. | 347/22 |
| 7,287,849 | B2 | 10/2007 | Adachi | |
| 7,784,929 | B2 | 8/2010 | Yamashita et al. | |
| 7,845,760 | B2 | 12/2010 | Hirakawa | |
| 2003/0174183 | A1 * | 9/2003 | Kato | 347/16 |
| 2005/0168521 | A1 * | 8/2005 | Suzuki et al. | 347/33 |
| 2006/0050124 | A1 | 3/2006 | Adachi | |
| 2006/0238596 | A1 * | 10/2006 | Mitsuhashi et al. | 347/104 |
| 2007/0195145 | A1 | 8/2007 | Yamashita et al. | |

(Continued)

FOREIGN PATENT DOCUMENTS

| | | | |
|---|---|---|---|
| JP | 03-227648 | A | 10/1991 |
| JP | H06-101711 | A | 4/1994 |

(Continued)

OTHER PUBLICATIONS

An Office Action; "Notice of Reasons for Rejection," issued by the Japanese Patent Office on May 26, 2015, which corresponds to Japanese Patent Application No. 2013-064089 and is related to U.S. Appl. No. 14/220,441.

(Continued)

*Primary Examiner* — Julian Huffman
*Assistant Examiner* — Sharon A Polk
(74) *Attorney, Agent, or Firm* — Studebaker & Brackett PC

(57) ABSTRACT

A cleaning roller is in press contact with a conveyance belt on the downstream side of a drive roller in a first direction. A controller controls a motor so that the conveyance belt is driven in a second direction opposite to the first direction when the cleaning roller cleans the conveyance belt.

19 Claims, 6 Drawing Sheets

(56) References Cited

U.S. PATENT DOCUMENTS

| | | | | |
|---|---|---|---|---|
| 2007/0229586 | A1 | 10/2007 | Hirakawa | |
| 2008/0107461 | A1* | 5/2008 | Miyata et al. | 399/343 |
| 2009/0185023 | A1* | 7/2009 | Higuchi et al. | 347/214 |
| 2010/0271419 | A1 | 10/2010 | Yamashita et al. | |
| 2011/0242152 | A1* | 10/2011 | Takeda et al. | 347/1 |
| 2012/0194603 | A1 | 8/2012 | Takeda et al. | |

FOREIGN PATENT DOCUMENTS

| | | | |
|---|---|---|---|
| JP | H07-049646 | A | 2/1995 |
| JP | H11-192694 | A | 7/1999 |
| JP | H11-192768 | A | 7/1999 |
| JP | 2000-272107 | A | 10/2000 |
| JP | 2004-136534 | A | 5/2004 |
| JP | 2005-053663 | A | 3/2005 |
| JP | 2007-223739 | A | 9/2007 |
| JP | 2007-268975 | A | 10/2007 |
| JP | 2010-280149 | A | 12/2010 |
| JP | 2012-158421 | A | 8/2012 |

OTHER PUBLICATIONS

An Office Action; "Notice of Reasons for Rejection," issued by the Japanese Patent Office on May 26, 2015, which corresponds to Japanese Patent Application No. 2013-064090 and is related to U.S. Appl. No. 14/220,441.

An Office Action; "Notice of Reasons for Rejection," issued by the Japanese Patent Office on May 19, 2015, which corresponds to Japanese Patent Application No. 2013-064091 and is related to U.S. Appl. No. 14/220,441.

* cited by examiner

BELT CLEANER AND IMAGE FORMING APPARATUS

INCORPORATION BY REFERENCE

The present application claims priority under 35 U.S.C. §119 to Japanese Patent Applications No. 2013-064089, No. 2013-064090, and No. 2013-064091, each filed Mar. 26, 2013. The contents of this application are incorporated herein by reference in their entirety.

BACKGROUND

The present invention relates to belt cleaners and image forming apparatuses.

Because of their compactness, low cost, silent operation, etc., ink jet recording devices are widely employed in printers, copiers, multifunction peripherals, etc. A plurality of nozzles provided at a nozzle head of an ink jet recording device eject ink droplets to perform image formation on a recording medium, such as paper.

Some inkjet recording device performs image formation in a manner that a conveyance belt conveys a recording medium, and the nozzle head ejects ink droplets toward the recording medium on the conveyance belt. A drive roller drives the conveyance belt in a conveyance direction of the recording medium (hereinafter referred to as a "first direction").

Upon occurrence of a jam (paper jam) or the like in the inkjet recording device having such a configuration, ink may adhere to a recording medium supporting surface of the conveyance belt to contaminate a recording medium to be conveyed next.

SUMMARY

A belt cleaner according to the first mode of the present disclosure is a belt cleaner which cleans a conveyance belt of a conveyance unit, the conveyance unit including the conveyance belt which supports a recording medium and a drive section which drives the conveyance belt in a first direction and a second direction opposite to the first direction. The belt cleaner includes: a cleaning member configured to clean the conveyance belt; and a belt controller configured to control the drive section. The cleaning member is in press contact with the conveyance belt on a downstream side of the drive section in the first direction. The belt controller drives the conveyance belt in the second direction when the cleaning member cleans the conveyance belt.

An image forming image forming apparatus according to the second mode of the present disclosure includes: a conveyance unit including a conveyance belt configured to support a recording medium and a drive section configured to drive the conveyance belt in a first direction and a second direction opposite to the first direction; a belt cleaner configured to clean the conveyance belt; and an image forming section configured to form an image on the recording medium. The belt cleaner includes: a cleaning member configured to clean the conveyance belt; and a belt controller configured to control the drive section. The cleaning member is in press contact with the conveyance belt on a downstream side of the drive section in the first direction. The belt controller drives the conveyance belt in the second direction when the cleaning member cleans the conveyance belt.

A belt cleaner according to the third mode of the present embodiment is a belt cleaner which cleans a conveyance belt of a conveyance unit, the conveyance unit including the conveyance belt which supports a recording medium and a drive section which drives the conveyance belt. The belt cleaner includes: a first cleaning member configured to clean one of surfaces of the conveyance belt; and a second cleaning member configured to clean the other surface of the conveyance belt.

An image forming apparatus according to the fourth mode of the present disclosure is an image forming apparatus including: a conveyance unit including a conveyance belt configured to support a recording medium and a drive section configured to drive the conveyance belt; a belt cleaner configured to clean the conveyance belt; and an image forming section configured to form an image on the recording medium. The belt cleaner includes: a first cleaning member configured to clean one of surfaces of the conveyance belt; and a second cleaning member configured to clean the other surface of the conveyance belt.

A belt cleaner according to the fifth mode of the present disclosure is a belt cleaner which cleans a conveyance belt of a conveyance unit, the conveyance unit including the conveyance belt which supports a recording medium and a drive section which drives the conveyance belt. The belt cleaner includes: a cleaning roller made from an elastic material having liquid absorbency; and a pushing member configured to elastically deform the cleaning roller. The pushing member pushes liquid absorbed in the cleaning roller inward of the cleaning roller.

An image forming apparatus according to the sixth mode of the present disclosure is an image forming apparatus including: a conveyance unit including a conveyance belt configured to support a recording medium and a drive section configured to drive the conveyance belt; a belt cleaner configured to clean the conveyance belt; and an image forming section configured to form an image on the recording medium. The belt cleaner includes: a cleaning roller made from an elastic material having liquid absorbency; and a pushing member configured to elastically deform the cleaning roller. The pushing member pushes liquid absorbed in the cleaning roller inward of the cleaning roller.

BRIEF DESCRIPTION OF THE DRAWINGS

FIG. 3 is an explanatory drawing for explaining operations of the conveyance unit and the lifting unit shown in FIG. 2, wherein

FIG. 4 is an explanatory drawing for explaining operations of the conveyance unit and the lifting unit according to the second embodiment, wherein

FIG. 5 is an explanatory drawing for explaining operations of the conveyance unit and the lifting unit according to the third embodiment, wherein

FIG. 6 is an explanatory drawing for explaining operations of the conveyance unit and the lifting unit according to the fourth embodiment, wherein

DETAILED DESCRIPTION

Figure 1:
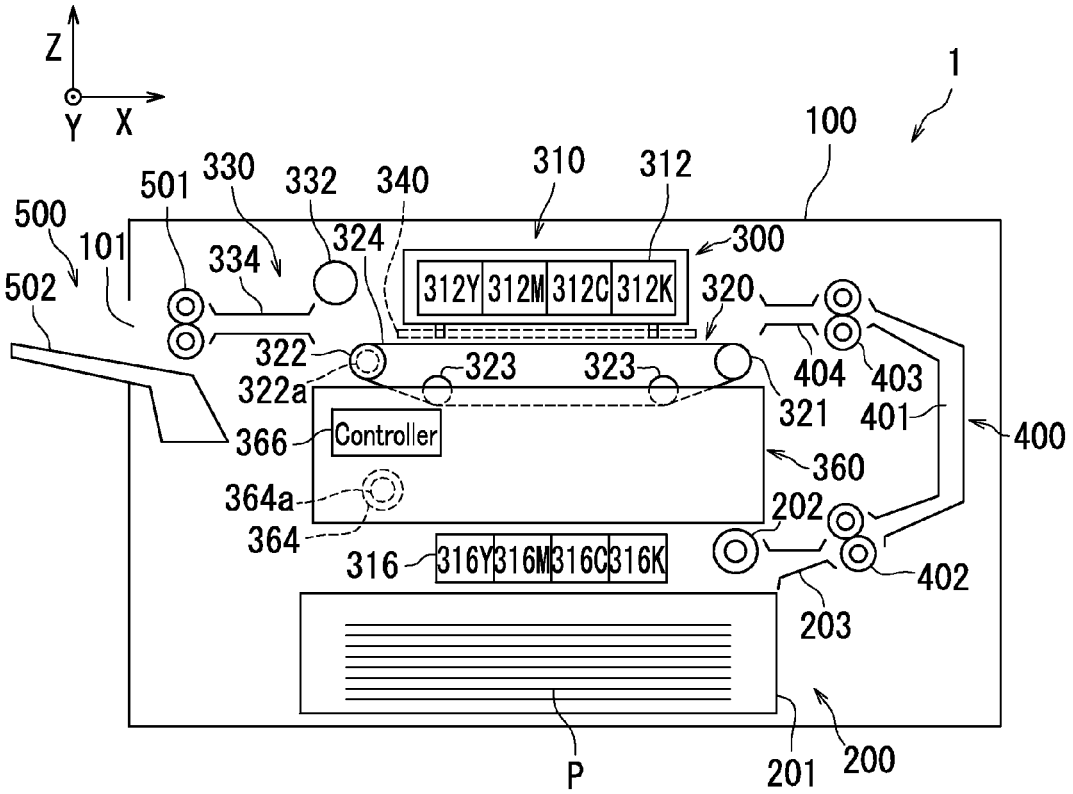
FIG. 1 is an illustration showing a schematic configuration of an inkjet recording device according to the first embodiment.

Embodiments of the present disclosure will be described below with reference to the accompanying drawings. FIG. 1 is an illustration showing a schematic configuration of an inkjet recording device 1 according to the first embodiment.

As shown in FIG. 1, the ink jet recording device 1 includes a device casing 100, a paper feed section 200 arranged in the lower part of the device casing 100, an image forming section 300 of inkjet recording type arranged above the paper feed section 200, a paper conveyance section 400 arranged on one side of the image forming section 300, and a paper ejection section 500 arranged on the other side of the image forming section 300.Z The paper feed section 200 includes a paper feed cassette 201 detachable from the device casing 100, a paper feed roller 202, and a guide plate 203.Z The paper feed roller 202 is arranged above one end of the paper feed cassette 201. The guide plate 203 is arranged between the paper feed roller 202 and the paper conveyance section 400. ZZ Paper P is stacked and accommodated as a plurality of recording mediums in the interior of the paper feed cassette 201. The paper feed roller 202 takes out the paper P in the paper feed cassette 201 on a sheet by sheet basis. The guide plate 203 guides the paper P taken out by the paper feed roller 202 to the paper conveyance section 400.

The paper conveyance section 400 includes a substantially C-shaped paper conveyance path 401, a conveyance roller pair 402 provided at the inlet of the paper conveyance path 401, a registration roller pair 403 provided at the outlet of the paper conveyance path 401, and a guide plate 404 arranged between the registration roller pair 403 and the image forming section 300.

The conveyance roller pair 402 sandwiches paper P fed from the paper feed section 200 and sends it out to the paper conveyance path 401. The registration roller pair 403 corrects skew of the paper P supplied from the paper conveyance path 401. The registration roller pair 403 temporarily keeps the paper P once waiting for synchronization of print timing with conveyance of the paper P, and then sends out the paper P to the guide plate 404 with print timing. The guide plate 404 guides the paper P sent out by the registration roller pair 403 to the image forming section 300.

The image forming section 300 includes a recording section 310, a conveyance unit 320, a dryer section 330, a nozzle cleaner 340, and a lifting unit 360.

The recoding section 310 includes a recording head 312 and a tank unit 316 arranged below the lifting unit 360.

The conveyance unit 320 includes a support roller 321, a drive roller 322, a pair of tension rollers 323, a conveyance belt 324, and a suction unit (not shown).

The conveyance belt 324 is endless and is wound to surround the support roller 321, the drive roller 322, and the tension rollers 323. A plurality of through holes (not shown) are formed to pass through the conveyance belt 324 in the thickness direction thereof.

A suction section including a fan, a vacuum pump, etc. is provided in the interior of the suction unit. When the suction section is driven, a negative pressure is generated in the interior of the suction unit. The negative pressure acts on paper P supported on one of the surfaces of the conveyance belt 324 through the plurality of through holes in the conveyance belt 324 to suck the paper P to the conveyance belt 324.

The drive roller 322 is spaced apart in a paper conveyance direction from the support roller 321. The drive roller 322 is driven and rotated by a motor 322*a* to rotate the conveyance belt 324 in a first direction as the paper conveyance direction and a second direction opposite to the first direction. The drive roller 322 and the motor 322*a* function as a drive section in the present disclosure. The tension rollers 323 are arranged under a part between the support roller 321 and the drive roller 322 to apply tension to the conveyance belt 324.

The recording head 312 includes four nozzle heads 312K, 312C, 312M, and 312Y arranged side by side from the upstream side to the downstream side in the paper conveyance direction.

The tank unit 316 includes four ink tanks 316K, 316C, 316M, and 316Y arranged side by side from the upstream side to the downstream side in the paper conveyance direction.

The nozzle heads 312K, 312C,312M, and 312Y each include a plurality of nozzles arranged in the width direction (Y direction) of the conveyance belt 324. The recording head 312 is of line head type. For example, the recording head 312 of line head type is fixed to the device casing 100.

Each of the nozzles of the nozzle head 312K communicates with a pressure chamber (not shown) formed in the interior of the nozzle head 312K.Z The pressure chamber communicates with an ink chamber (not shown) formed in the interior of the nozzle head 312K. The ink chamber communicates with an ink supply pump (not shown). The ink supply pump communicates with an ink tank 316K.

Each of the nozzles of the nozzle head 312C communicates with a pressure chamber (not shown) formed in the interior of the nozzle head 312C. The pressure chamber communicates with an ink chamber (not shown) formed in the interior of the nozzle head 312C. The ink chamber communicates with an ink supply pump (not shown). The ink supply pump communicates with an ink tank 316C.

Each of the nozzles of the nozzle head 312M communicates with a pressure chamber (not shown) formed in the interior of the nozzle head 312M. The pressure chamber communicates with an ink chamber (not shown) formed in the interior of the nozzle head 312M. The ink chamber communicates with an ink supply pump (not shown). The ink supply pump communicates with an ink tank 316M.

Each of the nozzles of the nozzle head 312Y communicates with a pressure chamber (not shown) formed in the interior of the nozzle head 312Y. The pressure chamber communicates with an ink chamber (not shown) formed in the interior of the nozzle head 312Y. The ink chamber communicates with an ink supply pump (not shown). The ink supply pump communicates with an ink tank 316Y.

The nozzle heads 312K, 312C, 312M, and 312Y eject ink to paper P conveyed by the conveyance belt 324 to form an image on the paper P.

The dryer section 330 includes a dryer 332 and a guide plate 334.

The dryer 332 blows hot wind to paper P to dry ink droplets ejected on the paper P from the recording head 312. It is noted that the dryer section 330 may be omitted. In one example, there is no need of drying ink according to the type of ink, which can allow the dryer section 330 to be omitted.

The guide plate 334 guides paper P sent out by the conveyance unit 320 to the paper ejection section 500.

The nozzle cleaner 340 is lifted up and down in the Z direction in association with lifting of the conveyance unit 320 by the lifting unit 360 and moves horizontally in the X direction by a horizontal movement mechanism (not shown).

The nozzle cleaner 340 can be positioned selectively between a wipe position and a retreat position by a moving operation by the horizontal movement mechanism. The nozzle cleaner 340 can perform cleaning on the nozzle heads 312K, 312C, 312M, and 312Y at the wipe position. The retreat position is separated in the horizontal direction from the wipe position. The nozzle cleaner 340 moves to the retreat position in image formation and moves to the wipe position in nozzle cleaning.

The paper ejection section 500 includes an ejection roller pair 501 and an exit tray 502. An exit port 101 is formed in the device casing 100. The exit tray 502 is fixed to the device casing 100 and protrudes outward from the exit port 101.

Paper P having passed through the dryer 332 is sent out by the ejection roller pair 501 toward the exit port 101, is guided to the exit tray 502, and is then ejected outside the device casing 100 through the exit port 101.

Figure 2:
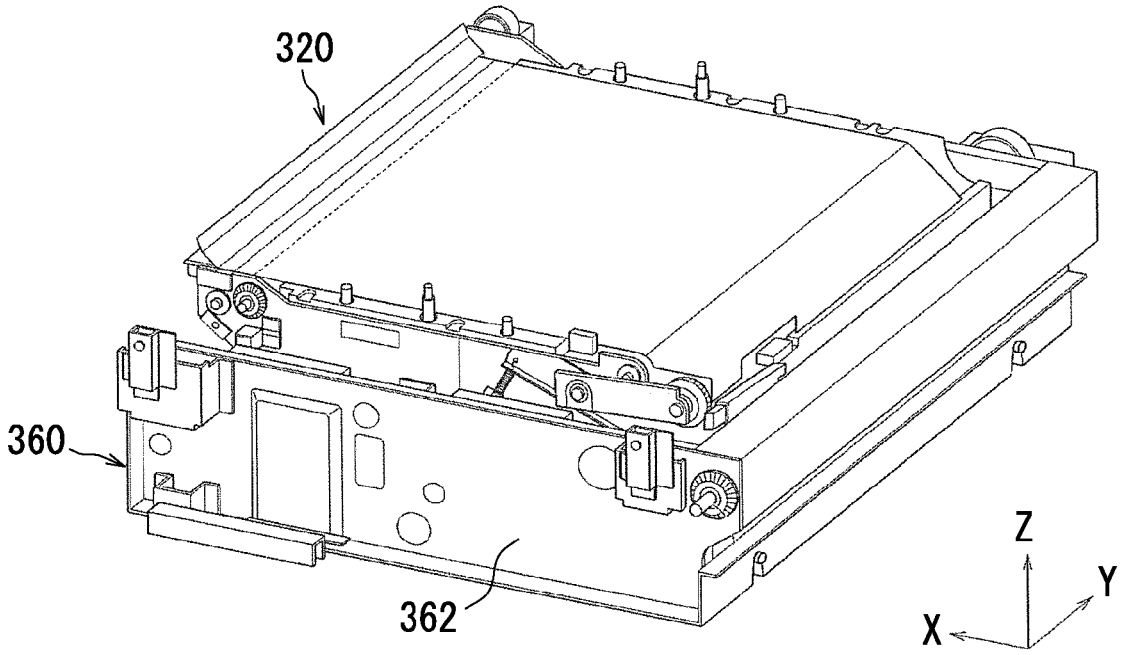
FIG. 2 is a perspective view of a conveyance unit and a lifting unit of the inkjet recording device shown in FIG. 1.

FIG. 2 is a perspective view of the conveyance unit 320 and the lifting unit 360 of the inkjet recording device 1 shown in FIG. 1.

The lifting unit 360 includes a lifting unit main body 362, a lifting section (not shown) to lift up and down the conveyance unit 320, a lifting detection section (not shown) to detect the position of the lifting section, a cleaning roller 364 (see FIG. 1), and a controller 366 (see FIG. 1). The lifting unit 360 functions as a belt cleaner in the present disclosure. The cleaning roller 364 functions as a cleaning member or a first cleaning member in the present disclosure.

The cleaning roller 364 is capable of being rotated in the same direction as the first direction and the same direction as the second direction by a motor 364*a* as a driving/rotating section or a first cleaning member driving/rotating section. Here, the words "the cleaning roller 364 is rotated in the same direction as the first direction" means that the rotation direction of a part of the cleaning roller 364 which is in contact with the conveyance belt 324 is the same as the first direction. In this case, the rotation direction of the motor 364*a* that drives and rotates the cleaning roller 364 is opposite to the rotation direction of the motor 322*a* that drives the conveyance belt 324 in the first direction. It is noted that the cleaning roller 364 is formed so as to include a material excellent in liquid absorbency. Examples of such a material may include a porous body and non-woven fabric. Further, preferably, the material of the cleaning roller 364 has a low friction coefficient in order to reduce degradation of the conveyance belt 324 and the cleaning roller 364 and to reduce sliding noise which may be caused between the cleaning roller 364 and the conveyance belt 324. One example of such a material may be a porous body having continuous air holes. Where the porous body having continuous air holes is used, the smaller the diameter of the air holes is, the smoother the surface of the cleaning roller 364 is. This can increase the ink damming capacity. Further, the higher the average porosity is, the higher the liquid absorbency is.

As the porous body, SOFROUS N (trade name), which is a polyurethane sponge by AION Co., Ltd., may be used, for example. It is noted that SOFROUS N has an average air hole diameter of 25 μm and an average porosity of 83%. In order to form the cleaning roller 364 with the use of a porous body, a sheet-shaped SOFROUS N with a thickness of 6 mm may be wound around the outer peripheral surface of a metal shaft with a diameter of 12 mm, for example.

One example of the non-woven fabric may be K10021M (trade name), GS felt by Toray Industries, Inc. as a polyester/polyurethane non-woven fabric. In order to form the cleaning roller 364 with the use of a non-woven fabric, the surface of the cleaning roller 364 may be formed so as to include a part formed of the non-woven fabric. In one example, a sheet-shaped GS felt, K10021M, with a thickness of 2.1 mm may be wound around the outer peripheral surface of a metal shaft with a diameter of 16 mm in a helical manner to form the cleaning roller 364.

The controller 366 is formed from a microcomputer including a CPU, a ROM, and a RAM. The CPU executes predetermined processing according to a program stored in the ROM. The controller 366 controls the motor 322*a* of the drive roller 322 and the motor 364*a* of the cleaning roller 364 on the basis of information output from the lifting detection section. The controller 366 functions as a belt controller, a cleaning member controller, a first cleaning member controller, a second cleaning member controller, or a cleaning roller controller in the present disclosure.

Figure 3A:
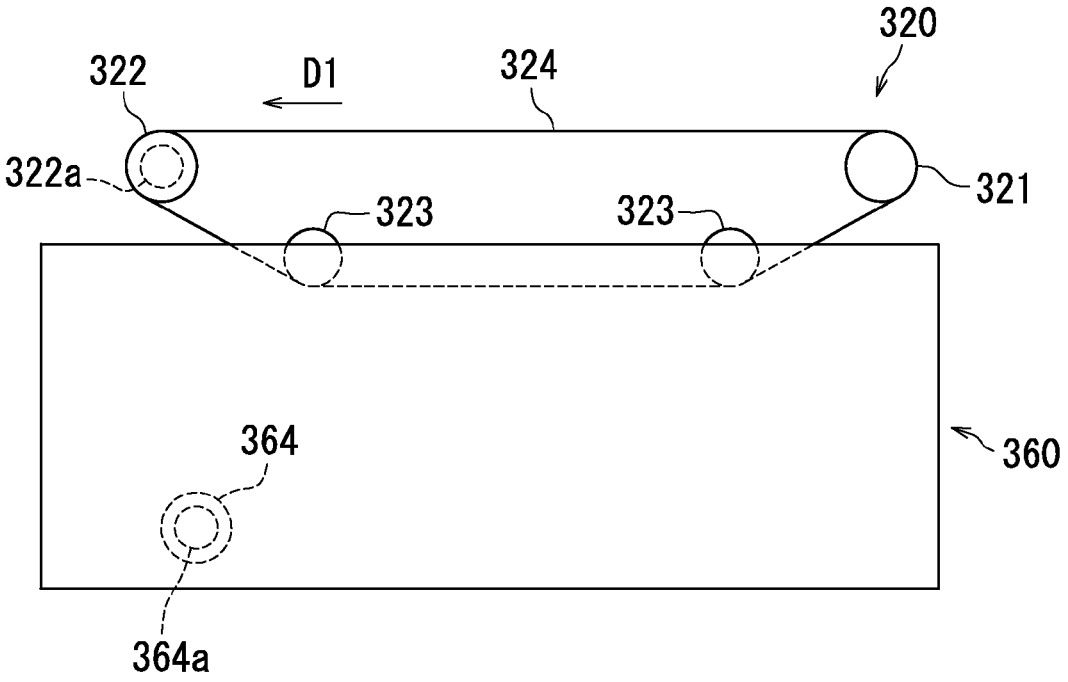
FIG. 3A shows a state in which the conveyance unit 320 is located at an image forming position.
Figure 3B:
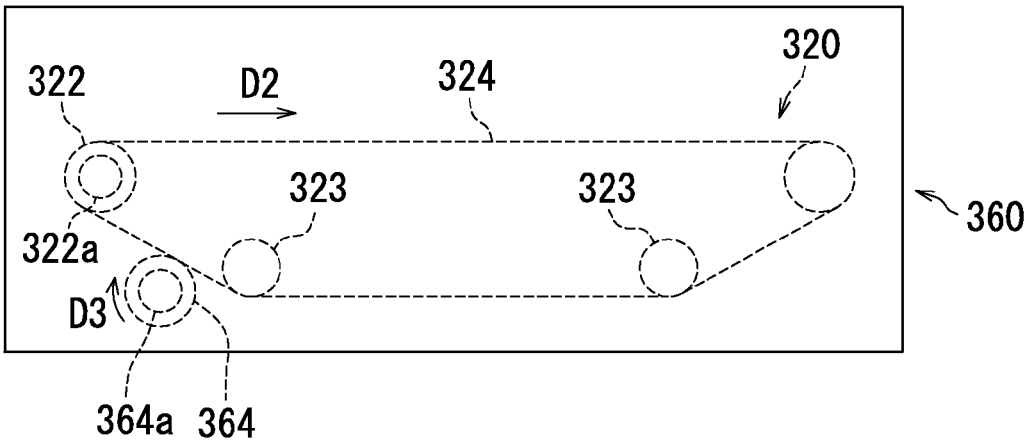
FIG. 3B shows a state in which the conveyance unit 320 is located at a cleaning position.

The first embodiment will be described next. FIG. 3 presents explanatory drawings for explaining operations of the conveyance unit 320 and the lifting unit 360 according to the first embodiment. FIG. 3A shows a state in which the conveyance unit 320 is located at an image forming position. FIG. 3B shows a state in which the conveyance unit 320 is located at a cleaning position.

In image formation, an image is formed on paper P in a manner that the nozzle heads 312K, 312C, 312M, and 312Y of the recording head 312 (see FIG. 1) eject ink onto the paper P, and the dryer 332 dries the ink on the paper P. In image formation, the conveyance belt 324 is driven in the first direction (direction indicated by the arrow D1).

Upon occurrence of a jam or the like in image formation, ink may adhere to the surface of the conveyance belt 324, on which paper P is supported. The ink adhering to the surface of the conveyance belt 324, on which the paper P is supported, may cause a drawback, such as contamination of paper P to be conveyed next. Accordingly, the conveyance belt 324 must be cleaned periodically or as necessary.

In cleaning, when the user inputs an instruction to start belt cleaning to the controller 366 through an operating panel (not shown), the lifting section of the lifting unit 360 goes down to bring down the conveyance unit 320. Then, as shown in FIG. 3B, when the conveyance unit 320 reaches the belt cleaning position, the lifting detection section detects the conveyance unit 320. Then, the lifting section stops.

As shown in FIG. 3B, the outer peripheral surface of the cleaning roller 364 comes in press contact with the surface of the conveyance belt 324, on which the paper P is supported, on the downstream side of the drive roller 322 in the first direction. Thereafter, the motor 322*a* of the drive roller 322 is driven to drive the conveyance belt 324 in the second direction (direction indicated by the arrow D2.).

The drive roller 322 drives the conveyance belt 324 by a friction force caused between itself and the conveyance belt 324. Accordingly, when the conveyance belt 324 is driven in the second direction, tension applied from the drive roller 322 to the conveyance belt 324 sets the conveyance belt 324 in a tensed state on the upstream side of the drive roller 322 in the second direction.

As a result, the cleaning roller 364 in press contact with the conveyance belt 324 receives a large counterforce from the conveyance belt 324, which results in a large press contact force generated between the conveyance belt 324 and the cleaning roller 364. Accordingly, the cleaning ability of the cleaning roller 364 on the conveyance belt 324 can be increased.

It is noted that in the case where the cleaning roller 364 is made from a material having high liquid absorbency, ink adhering to the conveyance belt 324 can be absorbed favorably, thereby further enhancing the cleaning effect of the cleaning roller 364 on the conveyance belt 324.

Further, in the present embodiment, the cleaning roller 364 is capable of moving into and out of contact with the conveyance belt 324. Only in cleaning on the conveyance belt 324, the cleaning roller 364 is in press contact with the conveyance belt 324. Accordingly, the conveyance belt 324 can be driven without disturbance by the cleaning roller 364 in image formation, thereby reducing adverse influence in image formation. Furthermore, the cleaning roller 364 is separated from the conveyance belt 324 in image formation to reduce damage to the cleaning roller 364. Thus, the lifetime of the cleaning roller 364 can be extended.

It is noted that when the cleaning roller 364 is driven and rotated in the same direction as the first direction (direction indicated by the arrow D3) in cleaning on the conveyance belt 324 by the cleaning roller 364, the relative speed between the conveyance belt 324 and the cleaning roller 364 increases to increase the friction force between the cleaning roller 364 and the conveyance belt 324. Accordingly, the cleaning effect of the cleaning roller 364 on the conveyance belt 324 can be further enhanced. It is noted that the cleaning roller 364 may be rotated by following the rotation of the conveyance belt 324. Yet further, a cleaning member (e.g., pad) other than a roller may be used in lieu of the cleaning roller 364.

The second embodiment of the present disclosure will be described next. FIG. 4 presents explanatory drawings for explaining operations of the conveyance unit 320 and the lifting unit 360 according to the second embodiment. It is noted that in the second embodiment, like numerals denote like elements in the first embodiment, and duplicate description shall be omitted.

In the present embodiment, the conveyance unit 320 includes a counter cleaning roller 325 which cleans the other surface of the conveyance belt 324. The counter cleaning roller 325 functions as a cleaning member or a second cleaning member in the present disclosure.

In the presence of the plurality of through holes in the conveyance belt 324, once ink adheres to one of the surfaces of the conveyance belt 324, it may pass through the through holes and adheres to the other surface of the conveyance belt 324. In this case, the conveyance belt 324 may slip on the drive roller 322 to cause image displacement or the like. In view of this, the counter cleaning roller 325 that cleans the other surface of the conveyance belt 324 is provided in the present embodiment.

The counter cleaning roller 325 may be made from the same material as the cleaning roller 364, for example. The counter cleaning roller 325 is arranged so as to face the cleaning roller 364 with the conveyance belt 324 interposed in cleaning on the conveyance belt 324. The counter cleaning roller 325 is rotatable in the same direction as the first direction and the same direction as the second direction by a motor 325*a* as a driving/rotating section or a second cleaning member driving/rotating section.

It is noted that the counter cleaning roller 325 is elastically supported to a frame (not shown) of the conveyance unit 320 through a spring 327 and is urged toward the other surface of the conveyance belt 324.

Figure 4A:
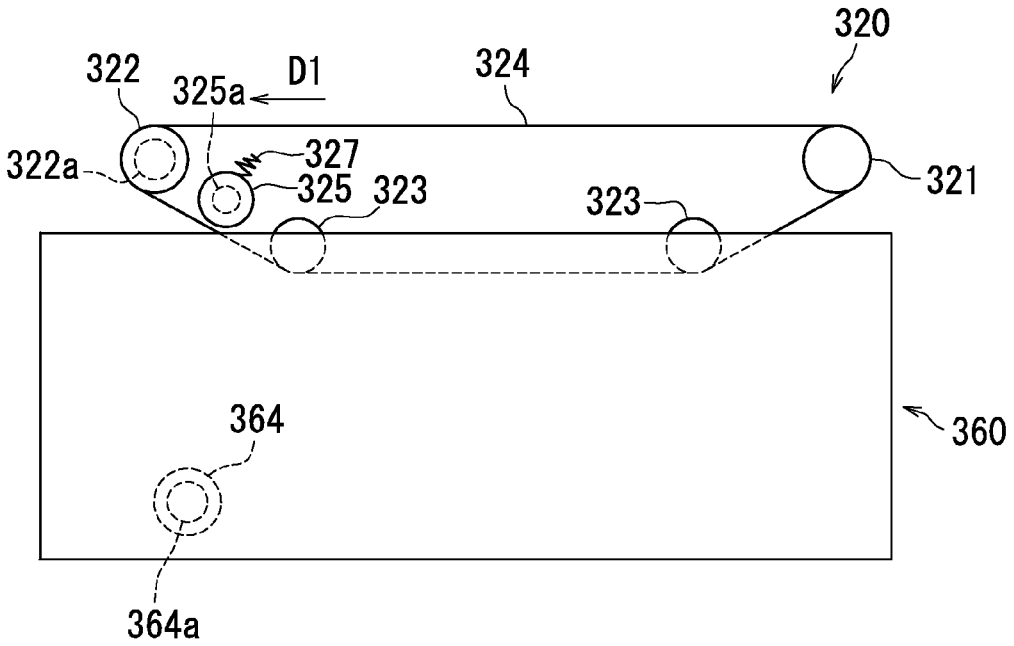
FIG. 4A shows a state in which the conveyance unit 320 is located at an image forming position.

The counter cleaning roller 325 is separated from the other surface of the conveyance belt 324 in image formation shown in FIG. 4A. Accordingly, the conveyance belt 324 can be driven without disturbance by the counter cleaning roller 325 in image formation. Further, since the counter cleaning roller 325 is separated from the conveyance belt 324 in image formation, the counter cleaning roller 325 can be prevented from being damaged, thereby extending the lifetime of the counter cleaning roller 325.

Figure 4B:
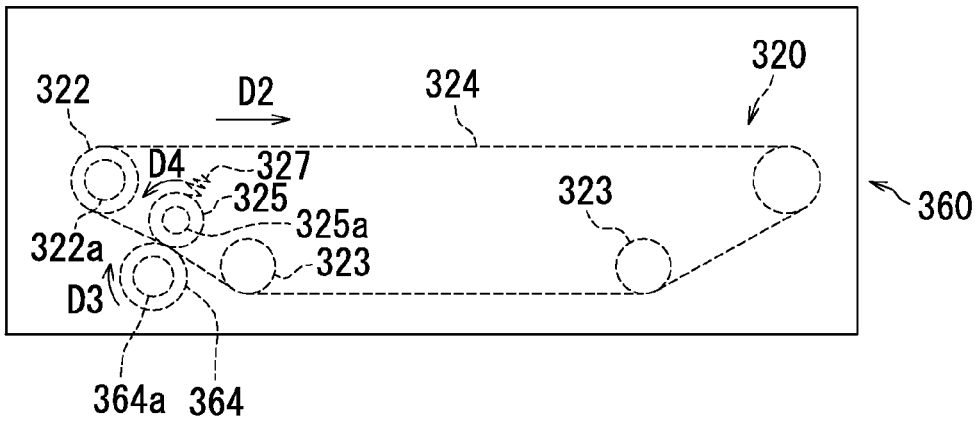
FIG. 4B shows a state in which the conveyance unit 320 is located at a cleaning position.

In cleaning shown in FIG. 4B, the cleaning roller 364 is in press contact with the conveyance belt 324 to bend the conveyance belt 324 inward, so that the other surface of the conveyance belt 324 comes in press contact with the counter cleaning roller 325. When the conveyance belt 324 is driven in the second direction (direction indicated by the arrow D2) in this state, the counter cleaning roller 325 cleans the other surface of the conveyance belt 324.

The counter cleaning roller 325 is elastically supported by the spring 327, which can mitigate a shock in press contact of the counter cleaning roller 325 to the conveyance belt 324. This can prevent the counter cleaning roller 325 and the conveyance belt 324 from being damaged.

It is noted that when the controller 366 (see FIG. 1) controls the motor 325*a* so that the counter cleaning roller 325 rotates in the same direction as the first direction (direction indicated by the arrow D4) in cleaning on the conveyance belt 324 by the counter cleaning roller 325, the relative speed between the counter cleaning roller 325 and the conveyance belt 324 increases to increase the friction force between the counter cleaning roller 325 and the conveyance belt 324. Thus, highly efficient cleaning on the conveyance belt 324 can be achieved. It is noted that the counter cleaning roller 325 may be rotated by following the rotation of the conveyance belt 324. Yet further, a cleaning member (e.g., pad) other than a roller may be used in lieu of the counter cleaning roller 325.

Figure 5A:
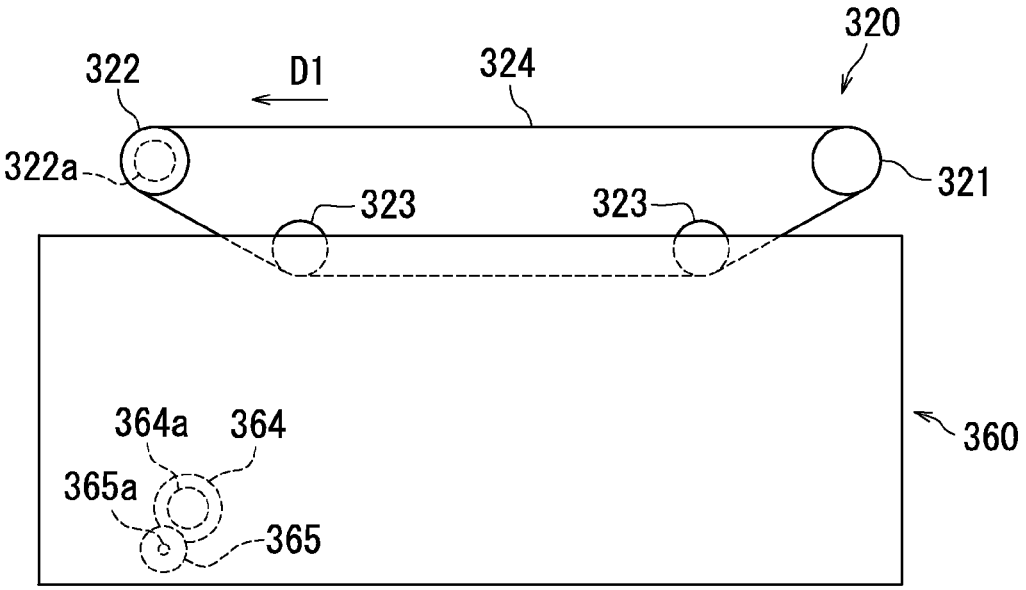
FIG. 5A shows a state in which the conveyance unit 320 is located at an image forming position.

The third embodiment of the present disclosure will be described next. FIG. 5 presents explanatory drawings for explaining operations of the conveyance unit 320 and the lifting unit 360 according to the third embodiment. It is noted that in the third embodiment, like numerals denote like elements in the first and second embodiments, and duplicate description shall be omitted.

As shown in FIG. 5, the lifting unit 360 in the present embodiment includes a pushing roller 365 as a pushing member. The pushing roller 365 is rotatably and pivotally supported to the casing of the lifting unit main body 362 through its support shaft 365*a*. The pushing roller 365 may be made from resin, metal, or the like, for example, and may be preferably made from a material having less friction with the cleaning roller 364. The pushing roller 365 is rotated by following the rotation of the cleaning roller 364 while compressing the rotating cleaning roller 364 to push liquid absorbed in the cleaning roller 364, such as ink, inward of the cleaning roller 364.

The pushing roller 365 rotates in the opposite direction to the rotation of the cleaning roller 364, which means small frictional resistance caused between the pushing roller 365 and the cleaning roller 364. Z Accordingly, the durability of the pushing roller 365 and the cleaning roller 364 can be increased. Also, the power consumption of the motor 364*a* can be reduced. The pushing roller 365 is rotated by following the rotation of the cleaning roller 364. This can simplify the configuration of the pushing roller 365, thereby reducing the manufacturing cost of the pushing roller 365. It is noted that the pushing roller 365 may be driven and rotated by a motor.

Preferably, the surface of the pushing roller 365 may be water repellent. In this case, the liquid absorbed in the cleaning roller 364 is prevented from moving to the pushing roller 365, so that the liquid is readily pushed inward of the cleaning roller 364.

Figure 5B:
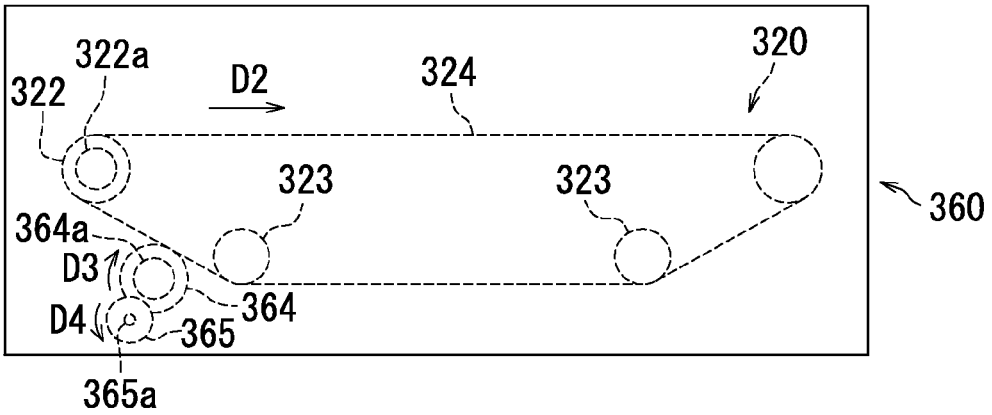
FIG. 5B shows a state in which the conveyance unit 320 is located at a cleaning position.

The third embodiment will be described next. In the state shown in FIG. 5A, when the user inputs an instruction to start belt cleaning to the controller through the operating panel (not shown) 366, the lifting section of the lifting unit 360 goes down to bring down the conveyance unit 320. Then, as shown in FIG. 5B, when the conveyance unit 320 reaches the belt cleaning position, the lifting detection section detects the conveyance unit 320. Then, the lifting section stops.

In this state, the outer peripheral surface of the cleaning roller 364 comes in press contact with the surface of the conveyance belt 324, on which the paper P is supported. Subsequently, the motor 322*a* of the drive roller 322 is driven to drive the conveyance belt 324 in the second direction (direction indicated by the arrow D2). Then, the motor 364*a* of the cleaning roller 364 is driven to rotate the cleaning roller 364 in the direction indicated by the arrow D3. The pushing roller 365 is rotated in the direction indicated by the arrow D4 by following the rotation of the cleaning roller 364.

Where the cleaning roller 364 is made from a material having high liquid absorbency, the cleaning roller 364 can favorably absorb ink adhering to the conveyance belt 324. Then, the ink absorbed in the cleaning roller 364 can be pushed inward of the cleaning roller 364 by the pushing roller 365. This can reduce the ink density at a part of the outer peripheral surface of the cleaning roller 364 where the pushing roller 365 pushes, thereby recovering the liquid absorbability at the part. Thus, the cleaning effect of the cleaning roller 364 on the conveyance belt 324 can be enhanced.

The belt cleaner in the present embodiment includes the cleaning roller 364 and the pushing roller 365. As such, the configuration of the belt cleaner is simple, and the manufacturing cost of the belt cleaner is low when compared with a belt cleaner that absorbs ink absorbed in the cleaning roller 364 with the use of a suction device, such as a pump.

It is noted that in the present embodiment, the cleaning roller 364 is driven and rotated in the same direction as the first direction (direction indicated by the arrow D3) in cleaning on the conveyance belt 324 by the cleaning roller 364. This can increase the relative speed between the cleaning roller 364 and the conveyance belt 324 to increase the friction force between the cleaning roller 364 and the conveyance belt 324. Thus, the cleaning effect of the cleaning roller 364 on the conveyance belt 324 can be enhanced. It is further noted that the cleaning roller 364 may be rotated by following the rotation of the conveyance belt 324.

Further, when the conveyance belt 324 is driven in the second direction, tension applied from the drive roller 322 to the conveyance belt 324 sets the conveyance belt 324 in a tensed state on the upstream side of the drive roller 322 in the second direction. Z Accordingly, the cleaning roller 364 in press contact with the conveyance belt 324 receives a large counterforce from the conveyance belt 324, so that the press contact force generated between the conveyance belt 324 and the cleaning roller 364 increases. Thus, the cleaning effect of the cleaning roller 364 on the conveyance belt 324 can be enhanced.

Moreover, the cleaning roller 364 is capable of moving into and out of contact with the conveyance belt 324 in the present embodiment. During the time only when the cleaning roller 364 cleans the conveyance belt 324, the cleaning roller 364 is in press contact with the conveyance belt 324. Accordingly, the conveyance belt 324 can be driven without disturbance by the cleaning roller 364 in image formation, thereby reducing adverse influence in image formation. Further, separation of the cleaning roller 364 from the conveyance belt 324 in image formation can reduce damage to the cleaning roller 364, thereby extending the lifetime of the cleaning roller 364.

Figure 6A:
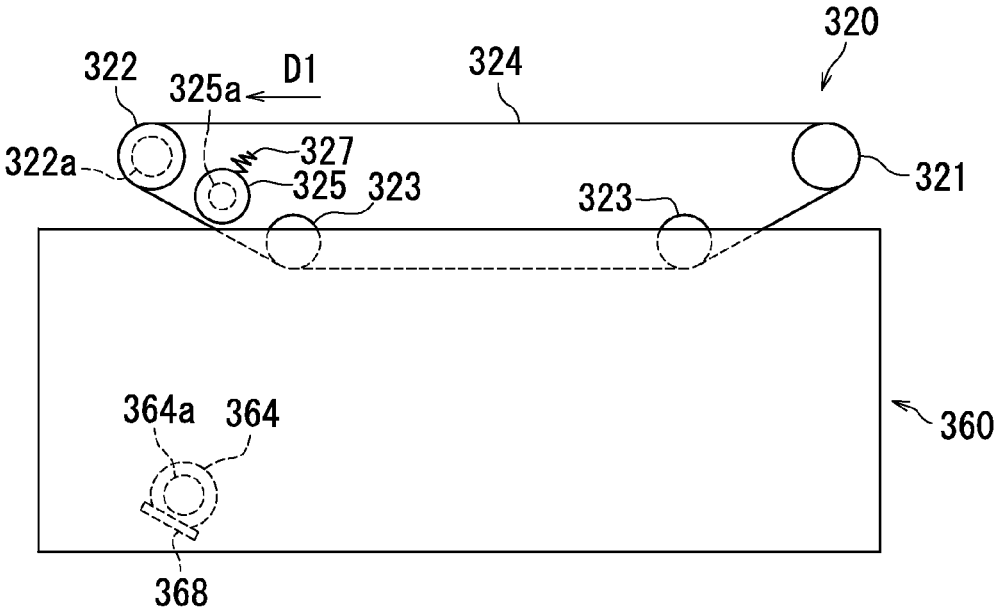
FIG. 6A shows a state in which the conveyance unit 320 is located at an image forming position.

The fourth embodiment of the present disclosure will be described next. FIG. 6 presents explanatory drawings for explaining operations of the conveyance unit 320 and the lifting unit 360 according to the fourth embodiment. It is noted that in the fourth embodiment, like numerals denote like elements in the first to third embodiments, and duplicate description shall be omitted.

A pushing plate 368 as a pushing member is provided at the cleaning roller 364 in the present embodiment. Further, the counter cleaning roller 325 that cleans the other surface of the conveyance belt 324 is provided in the present embodiment. The cleaning roller 364 and the counter cleaning roller 325 function as a first cleaning roller and a second cleaning roller, respectively, in the present disclosure.

The pushing plate 368 may be made from resin, metal, or the like, for example, and may be preferably made from a material with less frictional resistance with the cleaning roller 364. One example of such a material may be polyacetal (polyoxymethylene, POM).

The ink absorbed in the cleaning roller 364 is pushed inward of the cleaning roller 364 by the pushing plate 368. This can reduce the ink density at a part of the outer peripheral surface of the cleaning roller 364 where the pushing plate 368 pushes, thereby recovering the liquid absorbability at the part. Thus, the cleaning effect of the cleaning roller 364 on the conveyance belt 324 can be enhanced. It is noted that an additional pushing member may be provided at the counter cleaning roller 325. Alternatively, the pushing member may be provided only at the counter cleaning roller 325.

To the surface of the pushing plate 368, non-woven fabric having liquid absorbency may be attached. In this case, the pushing plate 368 can wipe off paper powder adhering to the cleaning roller 364. This can eliminate the need of maintenance of wiping off the paper powder adhering to the cleaning roller 364, or can extend intervals of the maintenance. One example of the non-woven fabric may be K10021M (trade name), GS felt by Toray Industries, Inc. as a polyester/polyurethane non-woven fabric.

The counter cleaning roller 325 in the present embodiment is rotatably supported to the casing of the lifting unit 360 through the support shaft 325*b* so as to be rotatable in the same direction as the first direction and the same direction as the second direction. The counter cleaning roller 325 is separated from the other surface of the conveyance belt 324 in image formation shown in FIG. 6A.

Figure 6B:
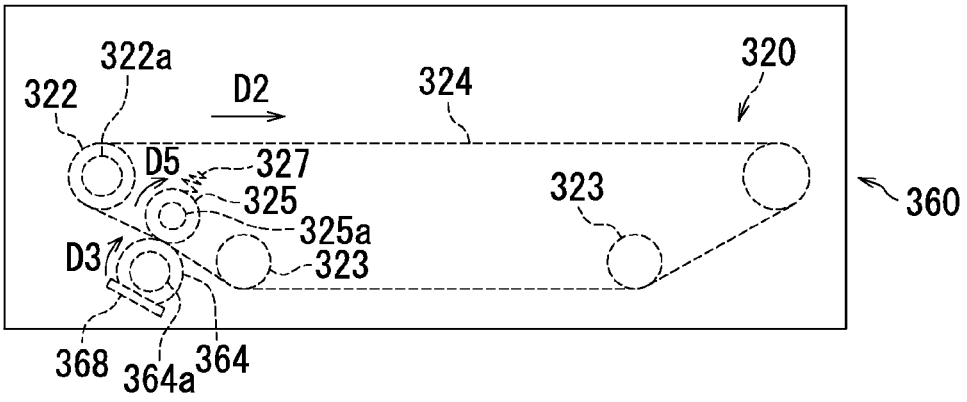
FIG. 6B shows a state in which the conveyance unit 320 is located at a cleaning position.

In cleaning shown in FIG. 6B, the cleaning roller 364 is in press contact with the conveyance belt 324 to bend the conveyance belt 324 inward, so that the other surface of the conveyance belt 324 comes in press contact with the counter cleaning roller 325. When the conveyance belt 324 is driven in the second direction (direction indicated by the arrow D2) in this state, the counter cleaning roller 325 is rotated by following the rotation of the conveyance belt 324 in the direction indicated by the arrow D5 to clean the other surface of the conveyance belt 324.

It is noted that the counter cleaning roller 325 may be rotated in the same direction as the first direction (opposite direction to the direction indicated by the arrow D5) by the motor 325*a* when the counter cleaning roller 325 cleans the conveyance belt 324. In this case, the relative speed between the counter cleaning roller 325 and the conveyance belt 324 increases to increase the friction force between the counter cleaning roller 325 and the conveyance belt 324. This can further enhance the cleaning effect of the counter cleaning roller 325 on the conveyance belt 324.

The embodiments of the present disclosure have been described so far. However, the present disclosure is not limited to the above embodiments described with reference to FIGS. 1-6, and various alterations of the above embodiments can be made.

In one example, although the conveyance unit goes up and down to move the cleaning member and/or the cleaning roller to and away from the conveyance belt in the above embodiments, another mechanism (e.g., plunger) may move the cleaning member and/or the cleaning roller to and away from the conveyance belt.

Further, the above embodiments describe the case where the present disclosure is applied to the belt cleaner that cleans the conveyance belt in which the through holes are formed. However, the present disclosure can be applied to belt cleaners that clean a conveyance belt in which no through hole is formed.

Furthermore, the above embodiments describes the case where the inkjet recording device performs image formation on paper. However, a recording medium on which the inkjet recording device performs image formation may be one other than the paper (e.g., plastic sheet, and fabric).

Still further, the above embodiments describe the case where the present disclosure is applied to the image forming apparatus including the image forming section of inkjet recording type. However, the present disclosure is applicable to image forming apparatuses including an image forming section of type other than the inkjet recording type (e.g., image forming apparatuses including an image forming section of electrographic type).

In addition, the above embodiments describe the case where the present disclosure is applied to the inkjet recording device including the recording head of line head type fixed to the device casing. However, the present disclosure is not limited to such an inkjet recording device. In one example, the present disclosure may be applied to inkjet recording devices including a recording head that moves relative to the device casing. In another example, the present disclosure may be applied to inkjet recording devices including a recording head of serial recording type.

Besides, various alterations of the above embodiments can be made within the scope not departing from the subject matter of the present disclosure.

What is claimed is:

1. A belt cleaner which cleans a conveyance belt of a conveyance unit, the conveyance unit including a support roller, a drive roller located opposite to the support roller, two tension rollers located below the support roller and the drive roller, the conveyance belt having an outer peripheral surface and an inner peripheral surface opposite to the outer peripheral surface and wound to surround the support roller, the drive roller, and the two tension rollers to support a recording medium on the outer peripheral surface thereof between the support roller and the drive roller, and a drive section that rotates the drive roller to drive the conveyance belt in a first direction and a second direction opposite to the first direction, the two tension rollers being located opposite to each other with a space left, the belt cleaner comprising:

a lifting unit configured to lift up and down the conveyance unit;

a cleaning member configured to clean the outer peripheral surface of the conveyance belt; and a belt controller configured to control the drive section, wherein the lifting unit moves the conveyance unit downward to a belt cleaning position when the cleaning member cleans the outer peripheral surface of the conveyance belt, upon the conveyance unit reaching the belt cleaning position, the cleaning member is in press contact with the outer peripheral surface of the conveyance belt between the drive roller and one of the tension rollers that is closer to the drive roller, and the belt controller drives the conveyance belt in the first direction in conveyance of the recording medium and drives the conveyance belt in the second direction when the cleaning member is in press contact with the outer peripheral surface of the conveyance belt.

2. A belt cleaner according to claim 1, wherein the cleaning member is a rotatable roller, the belt cleaner further comprising:

a driving/rotating section configured to drive and rotate the cleaning member; and a cleaning member controller configured to control the driving/rotating section, and the cleaning member controller causes the cleaning member to rotate in the same direction as a rotation direction of the drive roller when the cleaning member is in press contact with the outer peripheral surface of the conveyance belt.

3. A belt cleaner according to claim 1, wherein the cleaning member serves as a first cleaning member, and the belt cleaner further comprising a second cleaning member configured to clean the inner peripheral surface of the conveyance belt.

4. A belt cleaner according to claim 3, further comprising an elastic member located opposite to the conveyance belt with the second cleaning member therebetween and configured to elastically urge the second cleaning member toward the inner peripheral surface of the conveyance belt, wherein when the first cleaning member is in press contact with the outer peripheral surface of the conveyance belt, the second cleaning member is in press contact with the inner peripheral surface of the conveyance belt and is in press contact with the first cleaning member with the conveyance belt therebetween.

5. A belt cleaner according to claim 4, wherein the second cleaning member is a rotatable roller.

6. A belt cleaner according to claim 5, further comprising:

a driving/rotating section configured to drive and rotate the second cleaning member; and a cleaning member controller configured to control the driving/rotating section, wherein the cleaning member controller causes the second cleaning member to rotate in a direction opposite to a rotation direction of the drive roller when the second cleaning member is in press contact with the inner peripheral surface of the conveyance belt.

7. An image forming apparatus, comprising:

a conveyance unit including a support roller, a drive roller located opposite to the support roller, two tension rollers located below the support roller and the drive roller, a conveyance belt having an outer peripheral surface and an inner peripheral surface opposite to the outer peripheral surface and wound to surround the support roller, the drive roller, and the two tension rollers to support a recording medium on the outer peripheral surface thereof between the support roller and the drive roller, and a drive section that rotates the drive roller to drive the conveyance belt in a first direction and a second direction opposite to the first direction, the two tension rollers being located opposite to each other with a space left;

a belt cleaner configured to clean the conveyance belt; and an image forming section configured to form an image on the recording medium supported by the outer peripheral surface of the conveyance belt between the support roller and the drive roller, wherein the belt cleaner includes:

a lifting unit configured to lift up and down the conveyance unit;

a cleaning member configured to clean the outer peripheral surface of the conveyance belt; and a belt controller configured to control the drive section, the lifting unit moves the conveyance unit downward to a belt cleaning position when the cleaning member cleans the outer peripheral surface of the conveyance belt, upon the conveyance unit reaching the belt cleaning position, the cleaning member is in press contact with the outer peripheral surface of the conveyance belt between the drive roller and one of the two tension rollers that is closer to the drive roller, and the belt controller drives the conveyance belt in the first direction in conveyance of the recording medium and drives the conveyance belt in the second direction when the cleaning member is in press contact with the outer peripheral surface of the conveyance belt.

8. A belt cleaner which cleans a conveyance belt of a conveyance unit, the conveyance unit including a support roller, a drive roller located opposite to the support roller, two tension rollers located below the support roller and the drive roller, the conveyance belt having an outer peripheral surface and an inner peripheral surface opposite to the outer peripheral surface and wound to surround the support roller, the drive roller, and the two tension rollers to support a recording medium on the outer peripheral surface thereof between the support roller and the drive roller, and a drive section that rotates the drive roller to drive the conveyance belt, the two tension rollers being located opposite to each other with a space left, the belt cleaner comprising:

a first cleaning member configured to clean the outer peripheral surface of the conveyance belt between the drive roller and one of the two tension rollers that is closer to the drive roller; and a second cleaning member configured to clean the inner peripheral surface of the conveyance belt between the drive roller and one of the two tension rollers that is closer to the drive roller.

9. A belt cleaner according to claim 8, wherein the first cleaning member is a rotatable roller, the belt cleaner further comprising:

a cleaning member driving/rotating section configured to drive and rotate the first cleaning member;

a cleaning member controller configured to control the cleaning member driving/rotating section; and a belt controller configured to control the drive section, the belt controller drives the conveyance belt when the first cleaning member cleans the outer peripheral surface of the conveyance belt, and the cleaning member controller causes the first cleaning member to rotate in the same direction as a rotation direction of the drive roller when the first cleaning member cleans the outer peripheral surface of the conveyance belt.

10. A belt cleaner according to claim 8, wherein the second cleaning member is a rotatable roller, the belt cleaner further comprising:

a cleaning member driving/rotating section configured to drive and rotate the second cleaning member;

a cleaning member controller configured to control the cleaning member driving/rotating section; and a belt controller configured to control the drive section, and the belt controller drives the conveyance belt when the second cleaning member cleans the inner peripheral surface of the conveyance belt, and the cleaning member controller causes the second cleaning member to rotate in a direction opposite to a rotation direction of the drive roller when the second cleaning member cleans the inner peripheral surface of the conveyance belt.

11. A belt cleaner according to claim 8, wherein the first cleaning member and the second cleaning member are capable of moving into and out of contact with the conveyance belt.

12. A belt cleaner according to claim 11, wherein the drive section is capable of driving the conveyance belt in a first direction and a second direction opposite to the first direction, the belt cleaner further comprising; a belt controller configured to control the drive section, and the belt controller drives the conveyance belt in the first direction in conveyance of the recording medium and drives the conveyance belt in the second direction when the first cleaning member is in contact with the outer peripheral surface of the conveyance belt while the second cleaning member is in contact with the inner peripheral surface of the conveyance belt.

13. An image forming apparatus, comprising:

a conveyance unit including a support roller, a drive roller located opposite to the support roller, two tension rollers located below the support roller and the drive roller, a conveyance belt having an outer peripheral surface and an inner peripheral surface opposite to the outer peripheral surface and wound to surround the support roller, the drive roller, and the two tension rollers to support a recording medium on the outer peripheral surface thereof between the support roller and the drive roller, and a drive section that rotates the drive roller to drive the conveyance belt, the two tension rollers being located opposite to each other with a space left;

a belt cleaner configured to clean the conveyance belt; and an image forming section configured to form an image on the recording medium supported by the outer peripheral surface of the conveyance belt between the support roller and the drive roller, wherein the belt cleaner includes:

a first cleaning member configured to clean the outer peripheral surface of the conveyance belt between the drive roller and one of the two tension rollers that is closer to the drive roller; and a second cleaning member configured to clean the inner peripheral surface of the conveyance belt between the drive roller and one of the tension rollers that is closer to the drive roller.

14. A belt cleaner which cleans a conveyance belt of a conveyance unit, the conveyance unit including a support roller, a drive roller located opposite to the support roller, two tension rollers located below the support roller and the drive roller, the conveyance belt having an outer peripheral surface and an inner peripheral surface opposite to the outer peripheral surface and wound to surround the support roller, the drive roller, and the two tension rollers to support a recording medium on the outer peripheral surface thereof between the support roller and the drive roller, and a drive section that rotates the drive roller to drive the conveyance belt, the two tension rollers being located opposite to each other with a space left, the belt cleaner comprising:

a cleaning roller made from an elastic material having liquid absorbency; and a pushing member configured to elastically deform the cleaning roller and being rotated in a direction opposite to a rotation direction of the cleaning roller by rotation of the cleaning roller, wherein the cleaning roller cleans the conveyance belt between the drive roller and one of the tension rollers that is closer to the drive roller, and the pushing member pushes liquid absorbed in the cleaning roller inward of the cleaning roller.

15. A belt cleaner according to claim 14, wherein the cleaning roller is capable of moving into and out of contact with the conveyance belt.

16. A belt cleaner according to claim 15, further comprising:

a belt controller configured to control the drive section;

a driving/rotating section configured to drive and rotate the cleaning roller; and a cleaning roller controller configured to control the driving/rotating section, wherein the belt controller drives the conveyance belt when the cleaning roller cleans the conveyance belt, and the cleaning roller controller causes the cleaning roller to rotate such that a rotation direction of the cleaning roller is opposite to a driving direction of the conveyance belt at a part of the cleaning roller that is in contact with the conveyance belt when the cleaning roller cleans the conveyance belt.

17. A belt cleaner according to claim 15, wherein the drive section is capable of driving the conveyance belt in a first direction and a second direction opposite to the first direction, the belt cleaner further comprising: a belt controller configured to control the drive section, and the belt controller drives the conveyance belt in the first direction in conveyance of the recording medium and drives the conveyance belt in the second direction when the cleaning roller is in contact with the conveyance belt.

18. A belt cleaner according to claim 14, wherein the cleaning roller includes:

a first cleaning roller configured to clean the outer peripheral surface of the conveyance belt; and a second cleaning roller configured to clean the inner peripheral surface of the conveyance belt, and the pushing member is provided at the first cleaning roller and/or the second cleaning roller.

19. An image forming apparatus, comprising:

a conveyance unit including a support roller, a drive roller located opposite to the support roller, two tension rollers located below the support roller and the drive roller, a conveyance belt having an outer peripheral surface and an inner peripheral surface opposite to the outer peripheral surface and wound to surround the support roller, the drive roller, and the two tension rollers to support a recording medium on the outer peripheral surface thereof between the support roller and the drive roller, and a drive section that rotates the drive roller to drive the conveyance belt, the two tension rollers being located opposite to each other with a space left;

a belt cleaner configured to clean the conveyance belt; and an image forming section configured to form an image on the recording medium supported by the outer peripheral surface of the conveyance belt between the support roller and the drive roller, wherein the belt cleaner includes:

a cleaning roller made from an elastic material having liquid absorbency; and a pushing member configured to elastically deform the cleaning roller and being rotated in a direction opposite to a rotation direction of the cleaning roller by rotation of the cleaning roller, the cleaning roller cleans the conveyance belt between the drive roller and one of the tension rollers that is closer to the drive roller, and the pushing member pushes liquid absorbed in the cleaning roller inward of the cleaning roller.

* * * * *